US005951230A

United States Patent [19]

Kruzick et al.

[11] Patent Number: 5,951,230

[45] Date of Patent: Sep. 14, 1999

[54] SELF DUMPING HOPPER WITH CONTAINER LOCKING MECHANISM

[75] Inventors: Kent Kruzick, Wimanac; Dann L. Bailey, Sr., Knox, both of Ind.

[73] Assignee: Galbreath, Inc., Winamac, Ind.

[21] Appl. No.: 08/833,785

[22] Filed: Apr. 9, 1997

Related U.S. Application Data

[63] Continuation of application No. 08/513,489, Aug. 10, 1995, abandoned.

[51] Int. Cl.[6] ..... B66F 9/12

[52] U.S. Cl. ..... 414/421; 414/420; 414/424; 414/642; 414/645

[58] Field of Search ..... 414/420–422, 414/424, 607, 641, 642, 645, 646, 648, 652, 656, 658, 703, 720, 673; 292/209, 229; 267/171

[56] References Cited

U.S. PATENT DOCUMENTS

| | | | |
|---|---|---|---|
| 1,507,525 | 9/1924 | Stewart | 292/209 X |
| 2,888,157 | 5/1959 | Riley | 414/648 X |
| 3,027,032 | 3/1962 | Selby | 414/648 |
| 3,200,975 | 8/1965 | Chase | 414/424 |
| 3,212,802 | 10/1965 | Russell et al. | 267/171 X |
| 3,360,143 | 12/1967 | Allen | 414/424 |
| 3,414,147 | 12/1968 | Schroering | 414/421 |
| 3,486,648 | 12/1969 | DeWald | 414/420 |
| 3,968,984 | 7/1976 | Guth | 292/229 |
| 4,124,133 | 11/1978 | Rosin et al. | 414/648 |
| 4,358,241 | 11/1982 | Anderson | 414/702 |
| 4,403,901 | 9/1983 | Kopczynski | 414/422 |
| 5,011,360 | 4/1991 | Abram et al. | 414/424 |
| 5,064,338 | 11/1991 | Lawrence | 414/703 X |
| 5,364,224 | 11/1994 | Padgett | 414/703 |
| 5,391,360 | 2/1995 | Kochte et al. | 292/229 X |
| 5,558,485 | 9/1996 | Haynes | 414/421 |

FOREIGN PATENT DOCUMENTS

| | | | |
|---|---|---|---|
| 180694 | 5/1986 | European Pat. Off. | 414/420 |
| 2632256 | 12/1989 | France | 414/420 |
| 3217561 | 12/1982 | Germany | 414/420 |
| 0271099 | 8/1989 | Germany | 414/642 |
| 0040419 | 3/1979 | Japan | 414/424 |
| 1533999 | 1/1990 | U.S.S.R. | 414/421 |
| 1395016 | 5/1975 | United Kingdom | 414/420 |
| 2031845 | 4/1980 | United Kingdom | 414/641 |

*Primary Examiner*—James W. Keenan
*Attorney, Agent, or Firm*—Woodard, Emhardt, Naughton, Moriarty & McNett

[57] ABSTRACT

A self dumping hopper includes a base; a container having a pair of runners sized and configured to enable the container to rock upon the base, along a path and between a non-dumping rest position and a rearwardly angled dumping position; a guide assembly connected to either the base or the container, the guide assembly defining at least one guide path opening and being for engaging with a guide pin to restrain the container to rock within a desired path; at least one guide pin connected to the other of the base and the container and positioned to extend into and follow the at least one guide path opening; and, a latch mechanism connected to the base and container for releasable holding the container in the rest position, the latch mechanism having latched and unlatched positions and having a biasing assembly for urging the latch mechanism to the unlatched position when in the unlatched position.

12 Claims, 4 Drawing Sheets

SELF DUMPING HOPPER WITH CONTAINER LOCKING MECHANISM

This application is a continuation of application Ser. No. 08/513,489, filed Aug. 10, 1995, abandoned.

FIELD OF THE INVENTION

The present invention relates to the field of general purpose containers for transporting materials, and more specifically, to a self dumping hopper with a mechanism designed for automatically locking the container into a non-dumping position.

BACKGROUND OF THE INVENTION

Containers or hoppers are frequently used inside manufacturing facilities to facilitate the transport of various materials. They may be of varying dimensions and are typically adapted for handling by a forktruck. The hoppers may be used for scrap, trash, or even manufactured products—anything desired to be transported with the aid of a forktruck.

One type of hopper currently in use consists of a container open to the top and having a generally trapezoidal cross-section. The opposing identical trapezoidal sides of the container are curved and are fitted with runners at the rear and bottom to permit the container to roll backwards along a pair of tracks, thereby dumping or "pouring" the contents of the container. A latching mechanism at the front of the container holds the container in a non-dumping position. When it is desired to dump the container, the latch is manually disengaged. The weight of the contents of the container will usually cause the container to roll backwardly on its own along the tracks to dump the contents. There are, however, several undesirable features with this standard hopper design.

First, the pair of arcuate runners are provided with spaced apart, radially extending pins. The tracks of the hopper, upon which the container rocks, are provided with holes that are sized and spaced to precisely engage with the pins of the container. When the container is rocked back and forth on the tracks, the pins mate with the holes of the track to constrain the container within the desired rocking path. Fabrication of the pins and mating holes adds a significant expense to the hopper and requires fairly close tolerances to produce safe and reliable rocking action.

A second disadvantage with the present hopper design lies in the latching mechanism. Current latch mechanisms are typically disengaged by pivoting a handle, which disengages a hook on the end of the handle from a latch pin on the rockable container. These handles are designed to fall and stay into a locking position with the aid of gravity. When the forklift operator desires to dump the hopper, he will momentarily dismount the forklift and pivot the handle to release the container. There are times, however, when the weight distribution within the container is such that the container does not rock backwardly on its own. The operator may then get off the forklift again and either redistribute the load or manually push or kick the container to try to rock it backward. This and similar manipulations can make it difficult to operate the hopper as intended.

What is needed is a self dumping hopper design that is easier and less expensive to operate and is easier and more reliable to operate.

SUMMARY OF THE INVENTION

Generally speaking there is provided a self dumping hopper with a container latching assembly, the hopper having a pin and trace track configuration that provides both a guide to govern the rocking path of the container and a limit for such rocking action and provides for an automatic latching assembly that biases the latch handle to stay in either the latched or unlatched position.

A self dumping hopper includes a base; a container having a pair of runners sized and configured to enable the container to rock upon the base, along a path and between a non-dumping rest position and a rearwardly angled dumping position; guide means connected to either the base or the container, the guide means defining at least one guide path opening and being for engaging with a guide pin to restrain the container to rock within the desired path; at least one guide pin connected to the other of the base and the container and positioned to extend into and follow the at least one guide path opening; and, a latch mechanism connected to the base and container for releasably holding the container in the rest position, the latch mechanism having latched and unlatched positions and having biasing means for urging the latch mechanism to the unlatched position when in the unlatched position.

It is an object of the present invention to provide an improved self dumping hopper.

It is another object of the present invention to provide a self dumping hopper with an improved assembly for governing the rocking action of the hopper container.

It is a further object of the present invention to provide an improved self dumping hopper with a latching assembly that permits a one-handed operation to bias the latch assembly to stay in the unlocked position until the container is returned to the non-dumping position or is manually moved therefrom.

Further objects and advantages of the present invention will become apparent from the following description of the preferred embodiment.

DESCRIPTION OF THE PREFERRED EMBODIMENT

Figure 1:
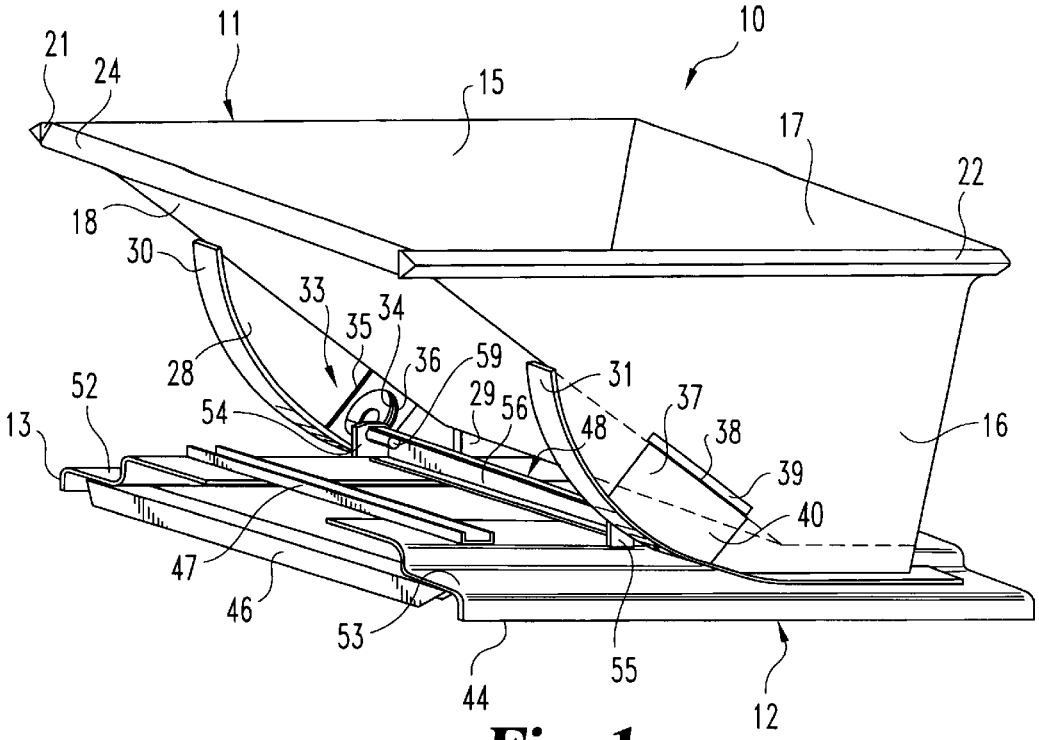
FIG. 1 is a perspective view of a self dumping hopper 10 in accordance with the preferred embodiment of the present invention and shown in the non-dumping rest position.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device, and further applications of the principles of the invention as illustrated therein are herein contemplated as would normally occur to one skilled in the art to which the invention relates.

Figure 2:
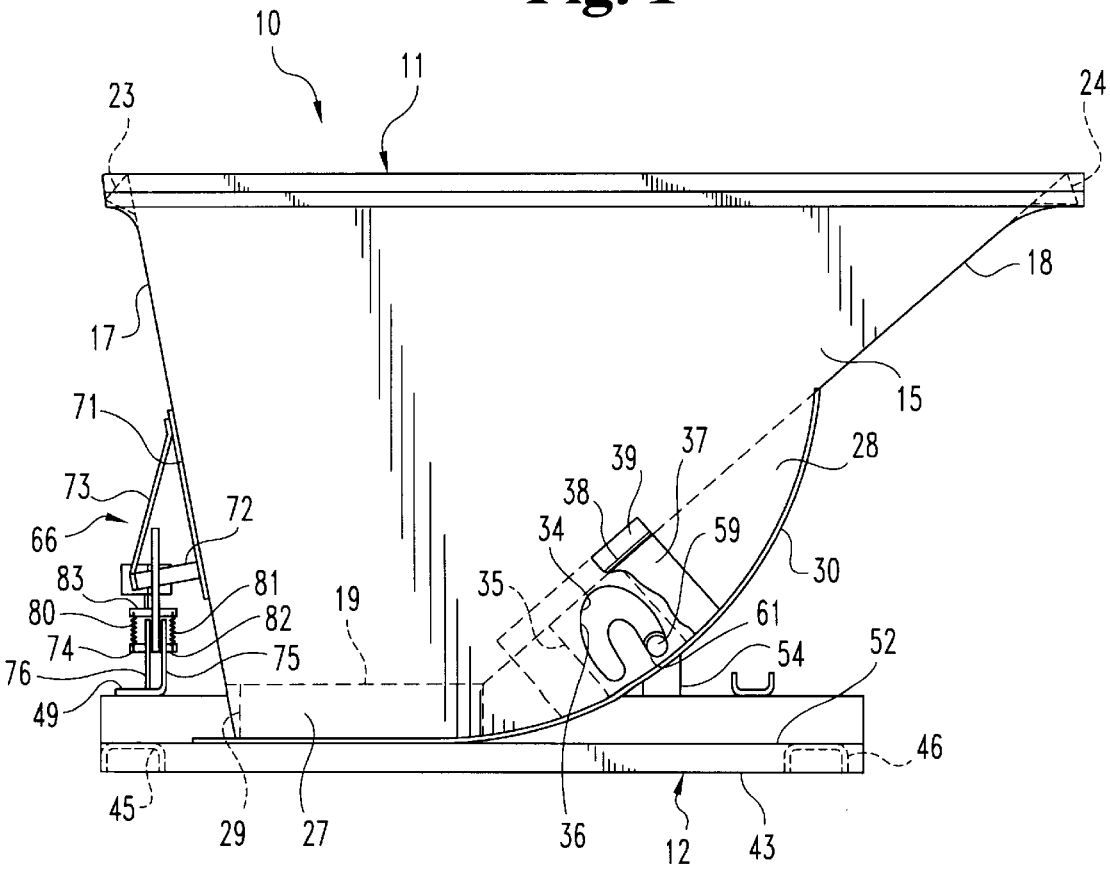
FIG. 2 is a side elevational view of the self dumping hopper 10 of FIG. 1.
Figure 3:
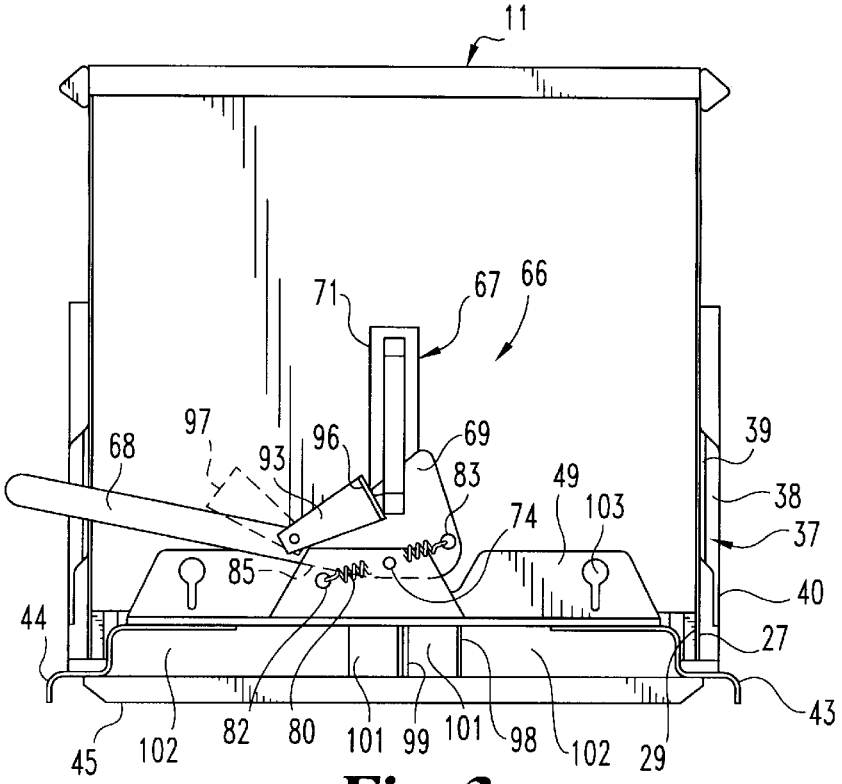
FIG. 3 is a front elevational view of the self dumping hopper 10 of FIG. 1.

Referring now to FIGS. 1, 2 and 3, there is shown a self dumping hopper 10 in accordance with the preferred embodiment of the present invention. Hopper 10 generally includes a container 11 and corresponding base 12. Container 10 comprises a pair of opposing side panels 15 and 16, a front panel 17, a rear panel 18, and a floor 19. Container 11 may be fabricated with panels 15–19 being cut from the same piece and folded and appropriately fixed together as by welding, or some or all of panels 15–19 may be cut separately and appropriately connected together, as by welding, into the configuration shown in FIGS. 1 and 2. Likewise, panels 17 and 18 and floor 19 could be made from a single piece of material bent into a non-cornered, arcuate shape. The top edges of panels 15–18 are bent out and around to form strengthening bumper strips 21–24 around the top perimeter of the container. Container 11 is open to the top and its longitudinal cross-section (i.e. roughly the side view of FIG. 2) is trapezoidal. Sides 15 and 16 are mirror images of each other and, for purposes of description, only one side will be described, it being understood that such description applies to both sides. Side panel 15 extends down below floor 19 in a generally rectangular configuration (at 27), and extends below and rearwardly of rear panel 18 in a generally arcuate section (at 28). A rectangular support leg 29 is connected to the underside of floor panel 19 and to the inside of rectangular portion 27 for additional support of container 11 on base 12. A runner 30 is firmly affixed as by welding to the bottom edge of side panel 15 to extend along the bottom of arcuate section 28 and continuously therefrom along the bottoms of both rectangular portion 27 and leg 29 and slightly forwardly thereof, as shown. That portion of runner 30 that lies below rectangular portion 27 is substantially flat enabling container 11 to sit in a stable, non-dumping position atop base 12 (FIG. 1). Container 11 may be rocked rearwardly, as described herein, on runners 30 and 31 (runner 31 being identical to runner 30 and positioned below side panel 16, as shown). This configuration is substantially similar to existing configurations except that the control means of current containers have pins that extend radially from runners 30 and 31 to register with mating holes in a corresponding base. Instead, hopper 10 of the present invention is provided with a container guide assembly 33 that will now be described.

Guide assembly 33 generally includes horseshoe shaped openings 34 and 36, a pin support assembly 48 and pins 59 and 60. Defined in arcuate section 28 is a horseshoe shaped opening or "trace track" 34. A trace track plate 35 is sized and configured to fit flat against the inside of arcuate section 28 and between rear panel 18 and runner 30. Plate 35 is rigidly connected, as by welding, to section 28, panel 18 and runner 30. Each connection of components described herein may be secured in any appropriate manner such as welding or by fasteners or by fabricating two or more pieces as a single unit. Plate 35 also defines a horseshoe shaped opening 36 that has the same shape as and is aligned with opening 34 of panel 15. As opening 34 is identically shaped and aligned with opening 36, for purposes of description, openings 34 and 36 will hereinafter collectively be referred to as combination opening 34. A cover plate 37 is connected to and on the outside of panel 15 to cover combination opening 34 to keep debris and fingers and the like clear of combination opening 34. Plate 37 is provided with a pair of double bends (at 38) which separates plate 37 into a top attachment strip 39 and a cover section 40. Strip 39 and section 40 lie in parallel planes. Plate 37 is rigidly connected as by welding along top strip 39 to side panel 15 and at the bottom of section 40 to runner 30. Cover section 40 is thus slightly distanced from the outside of side panel 15 to provide clearance to the follower pin 59, as will be described below.

Base 12 comprises left and right base members 43 and 44, front and rear Cross members 45 and 46, top cross member 47, pin support assembly 48 and latch mount 49. Each of base members 43 and 44 is fabricated to define a longitudinal flat surface or track 52 and 53, respectively, upon which ride runners 30 and 31, respectively. Cross members 45, 46 and 47 are rigidly connected to and extend between base members 43 and 44 to hold tracks 52 and 53 in parallel alignment. Pin support assembly 48 likewise is connected to and extends between base members 43 and 44, as shown. Pin support assembly 48 includes a pair of stanchions 54 and 55 and a pin support cross beam 56. Cross beam 56 extends between and is rigidly connected to stanchions 54 and 55, and stanchions 54 and 55 and beam 56 are all rigidly connected to base members 43 and 44. Container guide pins 59 and 60 (see FIGS. 1 and 4) extend through complementary shaped holes in corresponding stanchions 54 and 55 and are rigidly held in mutual coaxial alignment thereat as by welding. Pins 59 and 60 extend inwardly from stanchions 54 and 55 and are rigidly connected thereat to cross beam 56 for additional strength. Pins 59 and 60 extend outwardly of stanchions 54 and 55 a distance sufficient to extend through corresponding combination openings 34, but not so far as to touch cover plates 37. The axes of pins 59 and 60 are generally orthogonal to the path through which container 11 rocks, that path here being parallel with tracks 52 and 53. Pins 59 and 60 are of circular cross-sections, but could be shaped or configured as desired just so they (or it if only one) extend into and follow combination opening 34 while container 11 rocks to keep container 11 aligned in its rocking path.

Figure 6:
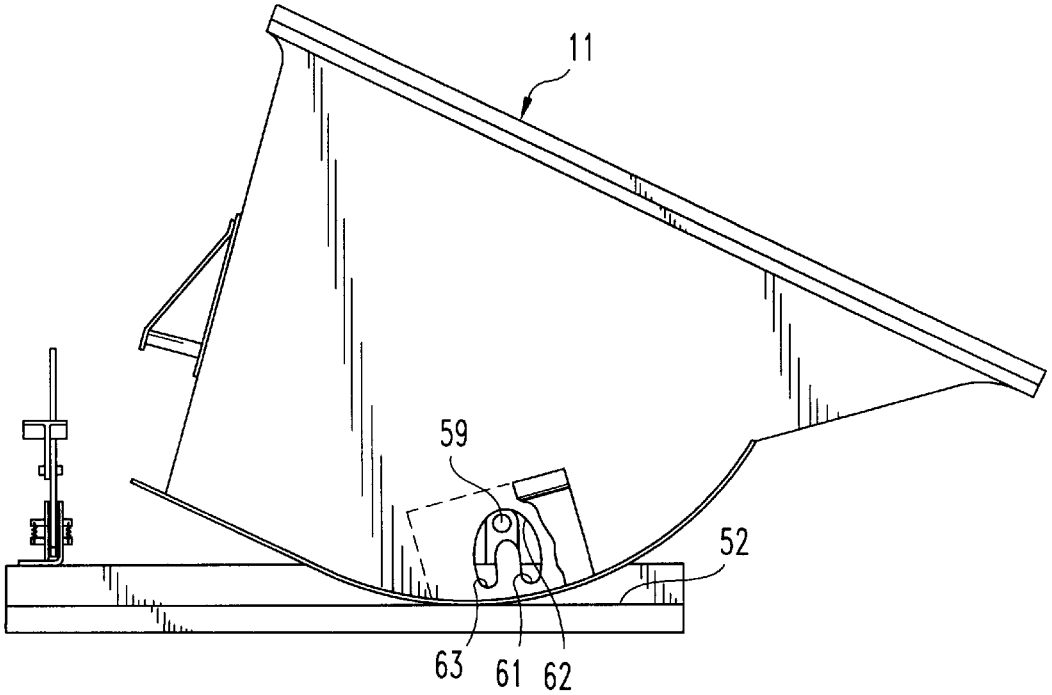
FIG. 6 is a side elevational view of the self dumping hopper 10 of FIG. 2, but shown midway between the non-dumping rest position and the rearwardly disposed dumping position.
Figure 7:
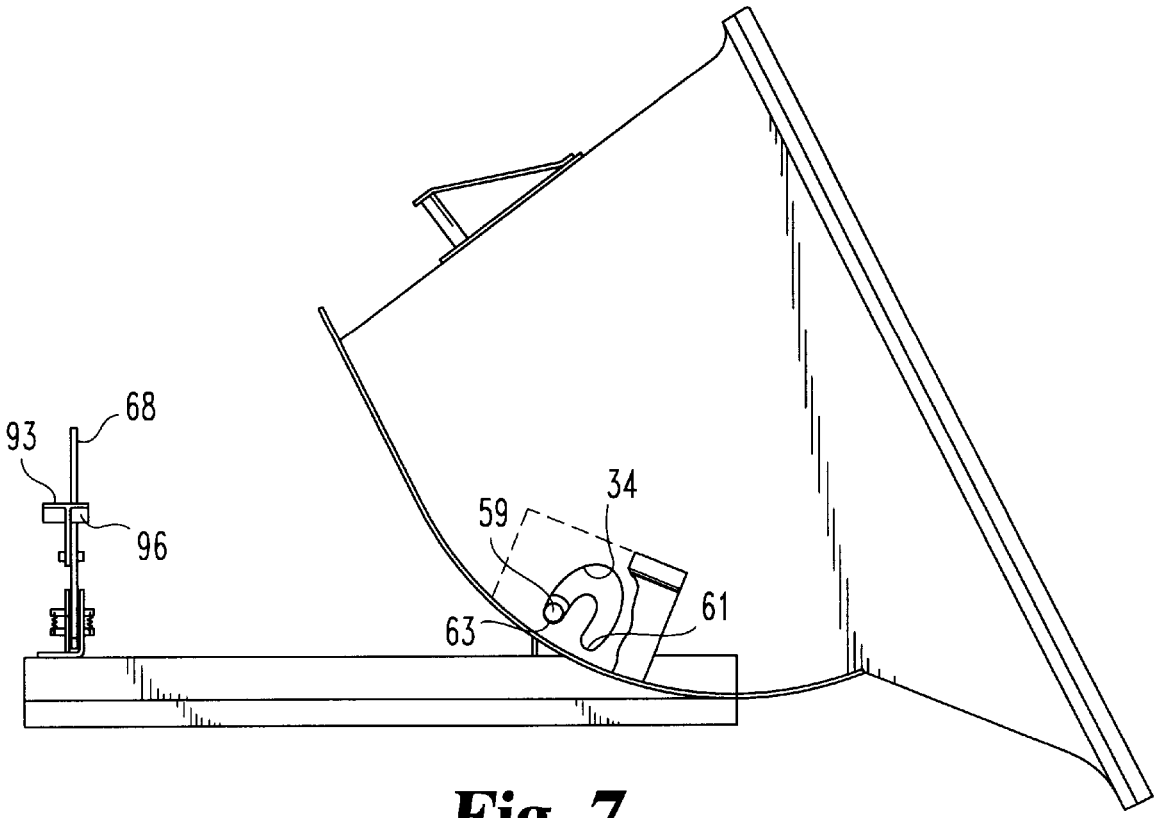
FIG. 7 is a side elevational view of the self dumping hopper 10 of FIG. 6, but shown in the rearwardly disposed dumping position.

Given the above described configuration, container 11 sits upon base 12 with runners 30 and 31 in contact with corresponding tracks 52 and 53, with pin 59 extending through combination opening 34 at side 15 and with pin 60 extending through its corresponding combination opening 34 (not shown) at side 16. Container 11 is thus permitted to rock rearwardly and forwardly along tracks 52 and 53 and pins 59 and 60 will follow within their corresponding combination opening 34 in mirror image fashion. For purposes of description, the following will refer to only the left side as viewed in FIGS. 2, 6 and 7.

In the non-dumping rest position shown in FIG. 2, pin 59 extends through the rearward lower end 61 of combination opening 34. As container 11 is permitted to rock rearwardly on tracks 52 and 53, pin 59 follows within combination opening 34 up through the top 62 of combination opening 34 and then down to the front lower end 63 of combination opening 34. When pin 59 engages with end 63, further rearward rocking of container 11 is prohibited. In other words, rearward lower end 61 and forward lower end 63 define the limits of rocking permitted to container 11 between the rest position shown in FIG. 2 and the dumping position shown in FIG. 7.

In one embodiment, runners 30 and 31 have a substantially constant radius, but the center of curvature varies slightly for points along the runners to vary the longitudinal travel of the container as a function of angular position. The shape of combination opening 34 is then dictated by the position of stationary pins 59 and 60 relative to arcuate sections 28 as container 11 rocks along runners 30 and 31 on stationary tracks 52 and 53 between the rest and dumping positions. Tolerances between pins 59 and 60 and combination openings 34 may vary as desired. Overall, the shape of runners 30 and 31 may vary depending on the size of container 11, and particularly on the ratio of the extension of the triangular rear portion of container 11 to the entire longitudinal dimension of container 11. The radii of curvature of points along runners 30 and 31 and the locations of the center of those radii affect the rate that container 11 rocks in relation to the weight distribution inside container 11. Since the shape of container 11 and its runners could vary from container to container, the shape of combination openings 34 may also vary. In one embodiment, combination opening 34 and its corresponding runner 30 are substantially as shown in FIG. 2.

Figure 4:
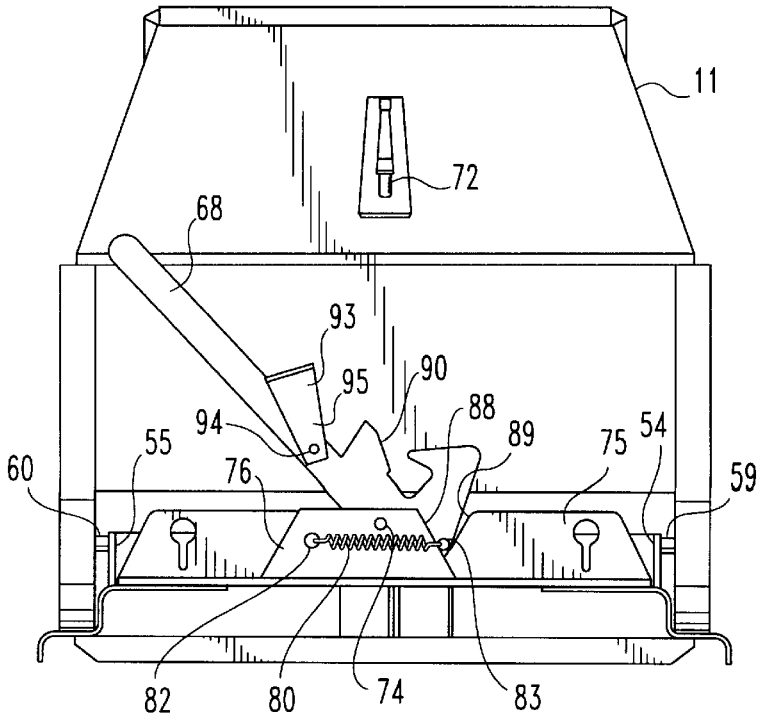
FIG. 4 is a front, elevational view of the self dumping hopper of FIG. 3, but shown in the rearwardly disposed dumping position.
Figure 5:
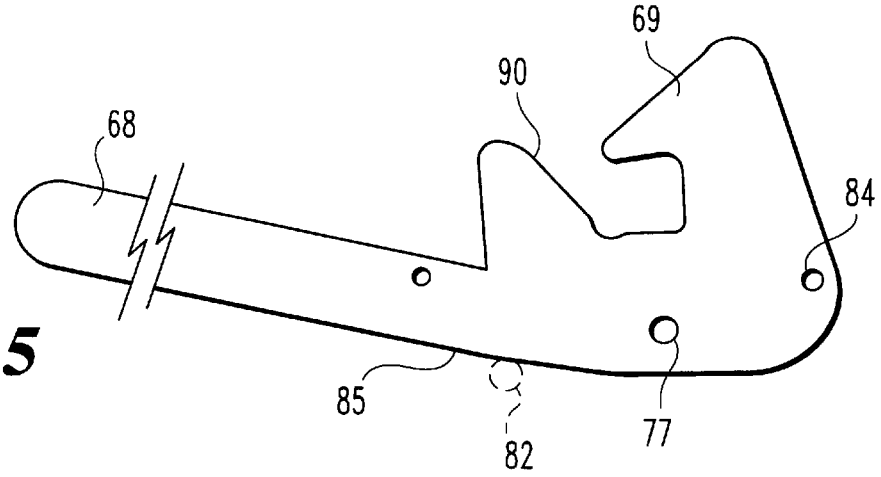
FIG. 5 is a view of the latch handle 68 of latching mechanism 66 of hopper 10 of FIG. 3.

Referring now to FIGS. 2–5, hopper 10 is provided with an automatic latching mechanism 66. Mechanism 66 generally includes a latch pin assembly 67 and a latch handle 68 with a latch hook 69 at the inboard end thereof. Latch pin assembly 67 has a mounting plate 71 and a latch pin 72 that is connected to and extends generally orthogonally from plate 71. A support bracket 73 extends from the outer end of pin 72 up to the top of mounting plate 71, as shown in FIG. 2. Latch handle 68 is pivotally supported about a latch mounting pin 74 by the rear wall 75 of L-shaped latch mount 49 and by pin support 76, as shown in FIGS. 2 and 3. Pin support 76 is connected to and extends upwardly from latch mount 49 in a plane generally parallel to rear wall 75. These components are assembled so that pin 74 extends through aligned holes in rear wall 75 and pin support 76 and through a hole 77 in handle 68, with handle 68 juxtaposed between rear wall 75 and pin support 76. Handle 68 is thus able to pivot about pin 74 between a latched position (FIG. 3) and an unlatched position (FIG. 4). Handle 68 is biased to stay in either the latched or unlatched position by a pair of springs 80 and 81. An anchor pin 82 extends through horizontally aligned holes in both rear wall 75 and pin support 76. A second anchor pin 83 is positioned through a hole 84 in handle 68 so that approximately the same amount of pin 83 extends on either side of handle 68. As shown in FIG. 2, springs 80 and 81 extend from anchor pin 82 up to anchor pin 83 with one spring being on each side of handle 68. Pin 82, as it extends between pin support 76 and rear wall 75 also functions as a stop to limit the counterclockwise rotation of handle 68 about latch mounting pin 74 (as shown in FIG. 3). That is, the underside 85 of handle 68 engages with pin 82 to limit rotation of handle 68 about pin 74 anymore than is shown in FIG. 3. Further, pin 82 is positioned by pin support 76 and rear wall 75 and pin 83 is positioned in handle 68 so that, when handle 68 is rotated to its counterclockwise limit (or its "locking position") as shown in FIG. 3, springs 80 and 81 extend between pins 82 and 83 along a line that is above pivot pin 74. Because the line connecting pins 82 and 83 is above pin 74, springs 80 and 81 urge handle 68 to rotate in a counterclockwise position thus urging handle 68 to remain locked. The right hand edge 88 of pin support 76 is configured to provide clearance for pin 83 as handle 68 is rotated from the locked position (FIG. 3) to the unlocked position (FIG. 4). Also, rear wall 75 defines a V-shaped cut out 89, the right hand edge as viewed in FIG. 4 being readily visible, and the left hand edge of V-shaped cut out 89 lying directly behind edge 88 of pin support 76, as viewed in FIG. 4. Edge 88 and the aligned, inside edge of V-shaped groove 89 are positioned to form a stop that is engaged by pin 83 when handle 68 is rotated clockwise as viewed in FIG. 4, thereby precluding rotation of handle 68 beyond that shown in FIG. 4. This clockwise extreme of handle 68 is the unlocked position. At this point, pin 83 has rotated downwardly so that the line connecting pins 82 and 83 is below pivot pin 74 and springs 80 and 81 pull pin 83 toward 82 thereby urging further clockwise rotation of handle 68. Thus when handle 68 is rotated to the unlocked condition, it is held thereat by springs 80 and 81 until manually pivoted to the locked condition or until container 11 is rotated back to the non-dumping position, thereby actuating handle 68 toward the locked condition as will next be described.

The inboard end of handle 68 defines the hook 69. Handle 68 also defines a cam surface 90. When handle 68 is in the unlocked condition (FIG. 4), as container 11 is tilted from the dumping position to the non-dumping, rest position, latch pin 72 will engage cam surface 90 and rotate handle 68 about pin 74 from the unlocked condition and against the bias of springs 80 and 81. The sizing and configuration of handle 68, springs 80 and 81, pins 82 and 83 and cam surface 90 may be designed to require varying degrees of force or momentum from the rocking of container 11 to its rest position in order to cause handle 68 to move completely to the locking condition shown in FIG. 3. That is, the components may be designed so that container 11 can be rocked to the rest position gently whereby the line between pins 82 and 83 will rise above pin 74 before the container is rocked all the way back to the rest position, thereby causing handle 68 to be biased toward the locking condition before container 11 has been rocked all the way to the rest position. In this manner, handle 68 will automatically continue its rotation to the locked position, which in turn pulls container 11 the rest of the way to the rest position. In the alternative, the components may be designed so that container 11 must be pushed with a moderate amount of force toward its rest position, the momentum being imparted through pin 72 and cam surface 90 to handle 68. In this configuration, the line connecting pins 82 and 83 would not pass above pivot pin 74 until handle 68 is just moving into the locking position. If the container is not rocked toward the rest position with sufficient force, the handle will not automatically be moved to the locking condition and further manual force will be required to lock down handle 68. In either configuration, once handle 68 is in the locked condition (FIG. 3) springs 80 and 81 act to keep handle 68 in that position.

Further insurance against handle 68 pivoting out of the locked position is provided by a safety latch 93. Safety latch 93 is pivotally mounted at pin 94 to handle 68 as shown in FIGS. 3 and 4. Safety latch 93 may be in a variety of configurations, but in the present embodiment it is generally T-shaped with the lower end of vertical member 95 being pivotally mounted at 94 to handle 68 and the upper cross member 96 being sized to engage on the left side of pin 72 when handle 68 is in the locked condition, as shown in FIG. 3. When safety latch 93 is in the locked position (FIG. 3) handle 68 is precluded from rotating about pin 74 as cross member 96 abuts the lower left side of latch pin 72. When safety latch 93 is pivoted about its pin 94 to the unlocked position (shown in phantom at 97) handle 68 may be freely rotated to unlock container 11.

A forklift guide 98 is fixed between latch mount 49 and front cross member 45. Guide 98 is V-shaped with the apex 99 of the "V" pointing forward. The sides 101 of guide 98 thus extend rearwardly and help guide the forks of a forklift into openings 102 between base members 43 and 44 above and cross member 45 below. Once loaded onto a forklift, a safety chain may extend from the forklift and hook into keyhole openings 103 to enable the forklift to tilt hopper 10 to assist the dumping action.

Other configurations are contemplated for container 11 to provide for rocking support on tracks 52 and 53. For example, runners 30 and 31 could be connected by spokes instead of by arcuate extensions (28) of sides 15 and 16. Or, runners 30 and 31 could be integrally incorporated with sides 15 and 16 as, for example, by bending the bottoms of arcuate sections 28 around to form runner-like surfaces. Further, combination opening 34 may be defined in other ways. For example, side panels 15 and 16, or just the arcuate sections 28 may be made strong enough to both support container 11 and to define horseshoe openings 34 to mate with pins 59 and 60. Also, pins 59 and 60 could be mounted to container 11 and the trace track openings 34 could be defined in a structure that is connected to or a part of base 12.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self dumping hopper, comprising:

a base with a pair of tracks;

a container having an opening and a pair of opposing runners sized and configured to rest upon and follow the tracks, at least a portion of the runners being curved to enable said container to be rocked along a path on the tracks between a non-dumping rest position and a rearwardly disposed dumping position;

guide means connected to one of said container and said base, for controlling the path of said container and defining at least one guide path opening sized to receive a guide pin, the guide path opening being generally horseshoe shaped;

at least one guide pin connected to the other of said container and said base and sized and positioned to extend horizontally into and follow the guide path opening while said container is rocked between the rest and dumping positions;

a latch mechanism for releasably holding said container in the rest position, said latch mechanism including a latch pin mounted to said container and including a handle with a hook, the handle being pivotally mounted to said base to pivot between an unlatched position, wherein said container may be rocked from said non-dumping rest position to said dumping position substantially unimpeded by the handle, and a latched position wherein when said container is in the non-dumping rest position, the hook engages with the latch pin and holds said container in the non-dumping rest position, and wherein said handle has first and second surfaces engagable by said latch pin when said container is rocked from said dumping position to said non-dumping rest position to pivot said handle from either its unlatched or latched positions until said latch pin is nested under the hook and held thereat by the handle in said latched position, said latch mechanism further including a spring connected between said base and said handle to bias said handle to stay in the latched position when said handle is in the latched position and to bias said handle to stay in the unlatched position when said handle is in the unlatched position.

2. A self dumping hopper, comprising:

a base with a pair of tracks;

a container having an opening and a pair of opposing runners sized and configured to rest upon and follow the tracks, at least a portion of the runners being curved to enable said container to be rocked along a path on the tracks between a non-dumping rest position and a rearwardly disposed dumping position;

guide means connected with said container and said base for controlling the path of said container; and, a latch mechanism for releasably holding said container in the rest position, said latch mechanism including a latch pin mounted to said container and including a handle with a hook, the handle being pivotally mounted to said base to pivot between an unlatched position, wherein said container may be rocked from said non-dumping rest position to said dumping position substantially unimpeded by the handle, and a latched position wherein when said container is in the non-dumping rest position, the hook engages with the latch pin and holds said container in the non-dumping rest position, and wherein said handle has first and second surfaces engagable by said latch pin when said container is rocked from said dumping position to said non-dumping rest position to pivot said handle from either its unlatched or latched positions until said latch pin is nested under the hook and held thereat by the handle in said latched position, said latch mechanism further including a spring connected between said base and said handle to bias said handle to stay in the latched position when said handle is in the latched position and to bias said handle to stay in the unlatched position when said handle is in the unlatched position.

3. The self dumping hopper of claim 1 wherein said latch mechanism includes a safety latch for releasably preventing said latch mechanism from being unlatched.

4. The self dumping hopper of claim 1 wherein said latch mechanism includes support means connected to said base and for supporting one or more pins, wherein said latch handle is pivotally supported by said support means about a pivot pin, wherein said latch mechanism includes a first pin connected to the handle and includes a second pin connected to the support means, and wherein the spring extends between the first and second pins.

5. The self dumping hopper of claim 4 wherein the first and second pin are juxtaposed on one side of the pivot pin in the latched position and on an opposite side of the pivot pin in the unlatched position.

6. The self dumping hopper of claim 1 wherein said hook has a generally C-shaped configuration with a central opening and with said first and second surfaces being defined on opposite sides of the central opening.

7. The self dumping hopper of claim 6 wherein the first and second surfaces each have a generally linear portion, the generally linear portion of the first surface being substantially orthogonal to the generally linear portion of the second surface.

8. The self dumping hopper of claim 2 wherein said latch mechanism includes a safety latch for releasably preventing said latch mechanism from being unlatched.

9. The self dumping hopper of claim 2 wherein said latch mechanism includes support means connected to said base and for supporting one or more pins, wherein said latch handle is pivotally supported by said support means about a pivot pin, wherein said latch mechanism includes a first pin connected to the handle and includes a second pin connected to the support means, and wherein the spring extends between the first and second pins.

10. The self dumping hopper of claim 9 wherein the first and second pin are juxtaposed on one side of the pivot pin in the latched position and on an opposite side of the pivot pin in the unlatched position.

11. The self dumping hopper of claim 2 wherein said hook has a generally C-shaped configuration with a central opening and with said first and second surfaces being defined on opposite sides of the central opening.

12. The self dumping hopper of claim 11 wherein the first and second surfaces each have a generally linear portion, the generally linear portion of the first surface being substantially orthogonal to the generally linear portion of the second surface.

* * * * *